US008698849B2

(12) United States Patent
Woo et al.

(10) Patent No.: US 8,698,849 B2
(45) Date of Patent: Apr. 15, 2014

(54) DISPLAY DEVICE AND DRIVING METHOD WITH FEEDBACK CONTROL

(75) Inventors: Won-myung Woo, Seoul (KR); Jin-hyung Lee, Anyang-si (KR); Gil-yong Chang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 615 days.

(21) Appl. No.: 12/948,872

(22) Filed: Nov. 18, 2010

(65) Prior Publication Data

US 2011/0134155 A1 Jun. 9, 2011

(30) Foreign Application Priority Data

Dec. 9, 2009 (KR) ..... 10-2009-0122045

(51) Int. Cl.
*G09G 5/10* (2006.01)

(52) U.S. Cl.
USPC ..... 345/690; 345/102; 345/211

(58) Field of Classification Search
USPC ..... 345/102, 211, 690
See application file for complete search history.

(56) References Cited

U.S. PATENT DOCUMENTS

| | | | | |
|---|---|---|---|---|
| 6,618,406 | B1 * | 9/2003 | Kaminishi | 372/38.02 |
| 7,495,397 | B2 * | 2/2009 | Okabe | 315/169.1 |
| 7,511,436 | B2 * | 3/2009 | Xu | 315/307 |
| 7,999,487 | B2 * | 8/2011 | Szczeszynski | 315/291 |
| 2009/0122003 | A1 * | 5/2009 | Chen et al. | 345/102 |
| 2011/0080111 | A1 * | 4/2011 | Nuhfer et al. | 315/291 |

* cited by examiner

*Primary Examiner* — Kwang-Su Yang
(74) *Attorney, Agent, or Firm* — Sughrue Mion, PLLC

(57) ABSTRACT

A display device and a driving method are provided. The display device includes: a display panel which displays an image; at least one light emitting diode (LED) which emits light to the display panel; a driver which supplies an operating voltage to the LED and drives the LED; a feedback unit which detects a level of a voltage drop of the LED and outputs a detection signal corresponding to the detected level of the voltage drop; and a first controller which controls a level of the operating voltage supplied to the LED based on the operating voltage supplied to the LED and the detection signal output by the feedback unit.

18 Claims, 4 Drawing Sheets

DISPLAY DEVICE AND DRIVING METHOD WITH FEEDBACK CONTROL

CROSS-REFERENCE TO RELATED APPLICATION

This application claims priority from Korean Patent Application No. 10-2009-0122045, filed Dec. 9, 2009 in the Korean Intellectual Property Office, the disclosure of which is incorporated herein by reference in its entirety.

BACKGROUND

1. Field

Apparatuses and methods consistent with exemplary embodiments relate to a display device and a driving method thereof, and more particularly, to a display device and a driving method thereof which drives a light emitting diode (LED) with high efficiency.

2. Description of the Related Art

An LED emits light when a voltage is applied in a forward direction. The LED employs electroluminescence effects and its light intensity is determined by an amount of current flowing through the LED. If the current exceeds a maximum rated current, the life time of the LED may become short and the LED may be damaged. Like other general diodes, the LED has a polarity and is turned on by applying a constant voltage from cathode to anode. When voltage is low, current barely flows and light is not emitted. Once the voltage reaches a certain level or higher, the current flows fast with respect to the rising voltage and the light is emitted in proportion to the amount of current. The voltage is called a forward voltage drop. The LED has a higher forward voltage drop compared to the general diodes. When the LED is used as a backlight for a display device, the display device needs an LED driving circuit to drive the LED and a pulse width modulation (PWM) dimming switch to adjust a brightness of the LED, and a metal oxide semiconductor field-effect transistor (MOSFET) is used as a switching element. The LED driving circuit includes the switching element, a PWM controller, an inductor, a capacitor to store power, and a diode to bypass the power stored in the inductor to the capacitor.

A backlight for a display panel may utilize a plurality of LEDs as a light source. Accordingly, a number of the LED driving circuits and the PWM dimming switches increases as the number of the LED increases. This may cause a switching loss from the switching element and may require many more elements including inductors. Thus, the circuits may become quite large and costly.

SUMMARY

Exemplary embodiments may address at least the above problems and/or disadvantages and other disadvantages not described above. Also, exemplary embodiments are not required to overcome the disadvantages described above, and an exemplary embodiment may not overcome any of the problems described above.

Exemplary embodiments provide a display device and a driving method thereof which simplifies an LED driving circuit and reduces a size of the driving circuit and material costs.

According to an aspect of an exemplary embodiment, there is provided a display device, including: an image processor which processes an input image signal; a display panel which displays an image based on the image signal processed by the image processor; at least one LED which emits light to the display panel; a driver which supplies an operating voltage to the LED and drive the LED; a feedback unit which detects a voltage drop of the LED and outputs a detection signal for the voltage drop; and a first controller which controls a level of the operating voltage supplied to the LED based on the operating voltage supplied to the LED and the detection signal for the voltage drop of the LED output by the feedback unit.

The first controller may decrease the operating voltage supplied to the LED if the voltage drop of the LED decreases.

The first controller may increase the operating voltage supplied to the LED if the voltage drop of the LED increases.

The first controller may detect a level of the operating voltage supplied to the LED based on a predetermined reference voltage, and the feedback unit may increase and decrease the reference voltage by outputting the detection signal corresponding to the voltage drop of the LED.

The feedback unit may include a first transistor which includes a first collector to adjust a current by a level of the voltage drop of the LED; a second transistor which includes a second collector to adjust a current corresponding to the first collector current of the first transistor; and a comparator which controls the second transistor to increase and decrease the current of the second collector of the second transistor corresponding to the increase and decrease of the current of the first collector of the first transistor.

The display device may include a field effect transistor (FET) which is connected in series to the LED; and a second controller which controls the FET to adjust a brightness of light emitted by the LED.

The controller may control the FET by a PWM.

The display device may include a third controller which controls the FET to maintain a level of the current flowing in the LED within a predetermined scope.

The third controller may include a resistor which is connected in series to the FET; and a comparator which controls the FET to decrease the current flowing in the FET if a voltage drop of the resistor increases.

According to an aspect of another exemplary embodiment, there is provided a driving method of a display device, the method including: driving at least one LED by supplying an operating voltage to the at least one LED supplying light to a display panel displaying an image based on an image signal; outputting a detection signal for a voltage drop by detecting the voltage drop of the LED; and controlling a level of the operating voltage supplied to the LED based on the operating voltage supplied to the LED and the detection signal for the voltage drop of the LED output by a feedback unit.

The controlling the level of the operating voltage may include reducing the operating voltage supplied to the LED if the voltage drop of the LED decreases.

The controlling the level of the operating voltage may include increasing the operating voltage supplied to the LED if the voltage drop of the LED increases.

The controlling the level of the operating voltage may include controlling the level of the operating voltage supplied to the LED based on a predetermined reference voltage, and the outputting the detection signal includes increasing and decreasing the reference voltage corresponding to the voltage drop of the LED.

The driving method may include controlling a brightness of light emitted by the LED.

The driving method may include maintaining a level of the current flowing in the LED within a predetermined scope.

BRIEF DESCRIPTION OF THE DRAWINGS

The above and/or other aspects will become more apparent by describing certain exemplary embodiments, with reference to the accompanying drawings, in which.

DETAILED DESCRIPTION OF EXEMPLARY EMBODIMENTS

Figure 1:
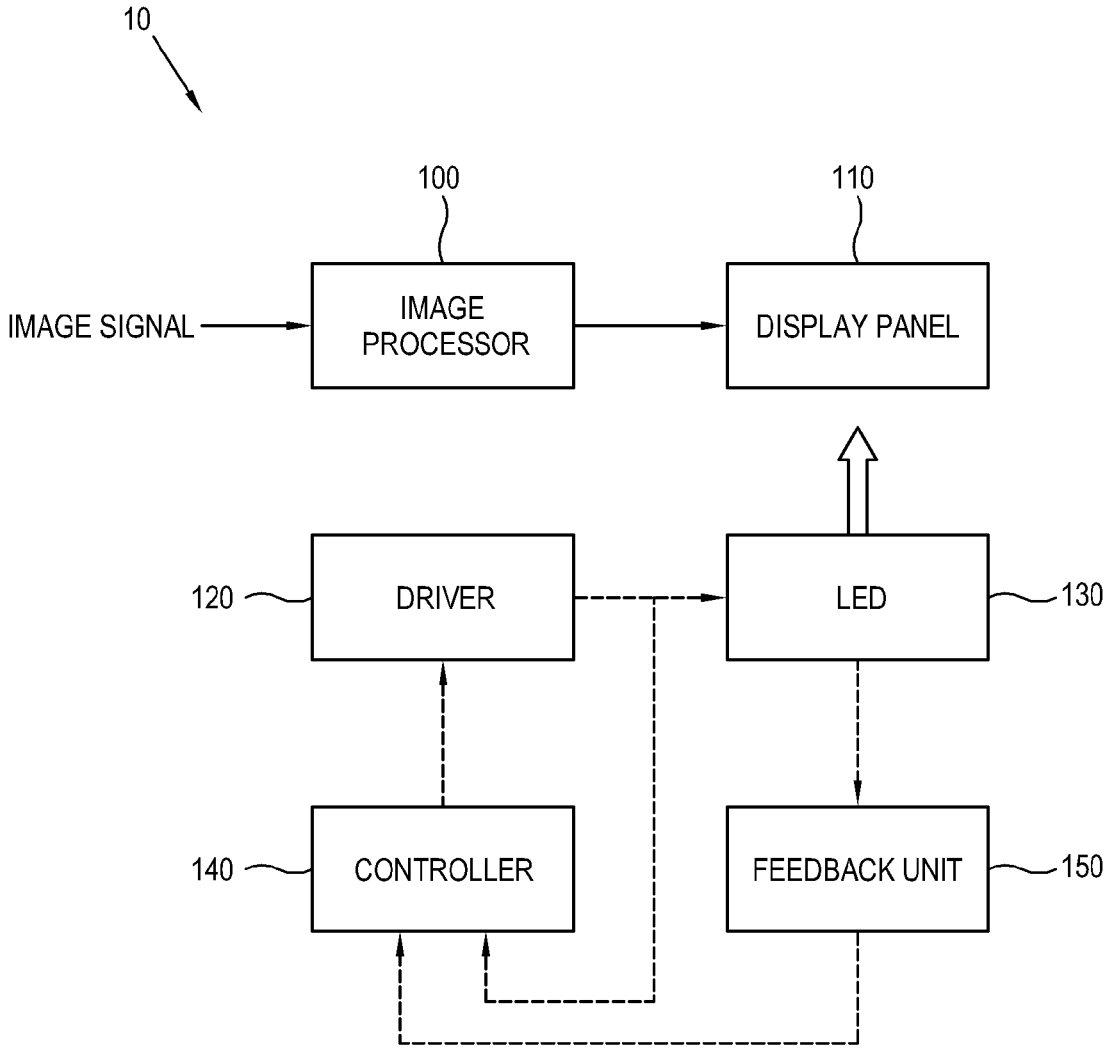
FIG. 1 is a block diagram of a display device according to an exemplary embodiment.

Certain exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters.

FIG. 1 is a block diagram of a display device 10 according to an exemplary embodiment. As shown therein, the display device includes an image processor 100, a display panel 110, at least one LED 130, a driver 120, a feedback unit 150, and a first controller 140.

The image processor 100 processes an image to be displayed based on a received image signal. The image processor 100 decodes, enhances, and scales an image. The image processor 100 may process a received audio signal and a data signal.

The display panel 110 displays thereon an image based on an image signal processed by the image processor 100. That is, the display panel 110 may display thereon data information included in a data signal processed by the image processor 100. The display device 10 may further include an audio output unit, such as a speaker, to output an audio based on the audio signal processed by the image processor 100.

The display panel 110 may include a liquid crystal display (LCD) panel which displays an image when light is emitted by a backlight unit.

The backlight unit may be a direct-type in which a light source is provided in a rear side of the LCD panel and emits light to the LCD panel through a diffusion panel and a prism sheet. Alternatively, the backlight unit may be an edge-type in which a light source provided in a lateral side of a light guiding plate and emits light from an upper side of the light guiding plate to the LCD panel through the diffusion sheet and the prism sheet.

The light source may include a linear light source, such as a cold cathode fluorescent lamp, or a point light source, such as an LED. In an exemplary embodiment, the LED is provided as a backlight unit, but exemplary embodiments are not limited thereto.

When a current flows, the LED 130 emits light to the display panel 110. A plurality of LEDs 130 may be provided to supply enough light to the display panel 110.

The driver 120 is provided in a rear side of the backlight unit and supplies an operating voltage Vo to the LED 130 to drive the LED 130. The operating voltage Vo which is supplied to the LED 130 is determined in consideration of a voltage drop of the LED 130.

The feedback unit 150 detects a voltage drop of the LED 130 and outputs a detection signal. The feedback unit 150 detects the voltage drop of the LED 130 to reduce power consumption.

The first controller 140 controls the driver 120 based on the operating voltage Vo supplied to the LED 130 and the detection signal output by the feedback unit 150, and adjusts a level of the operating voltage Vo supplied to the LED 130. An operation of the display device 10 according to an exemplary embodiment is described in greater detail below.

Figure 2:
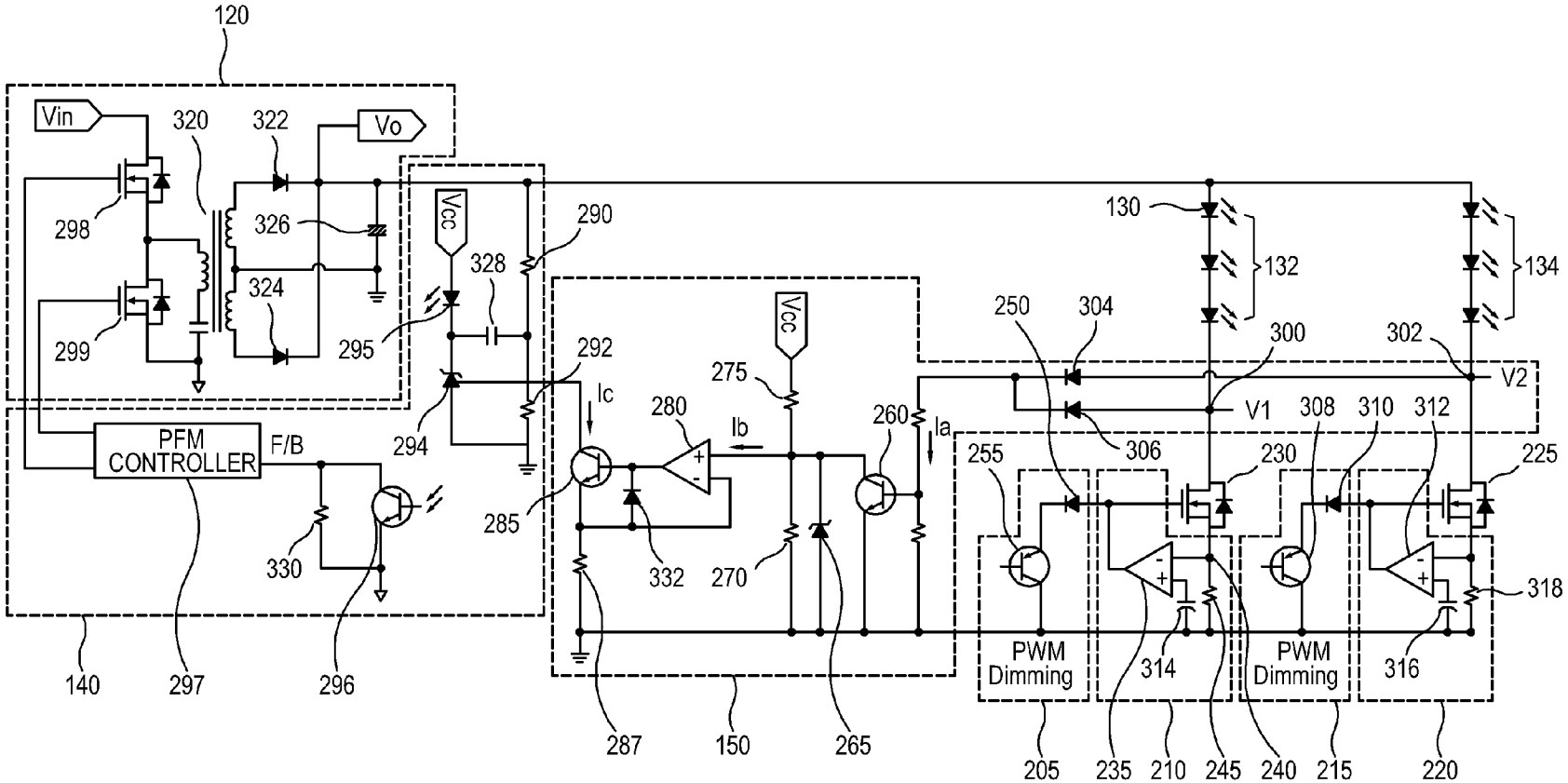
FIG. 2 is a circuit diagram of a display device according to an exemplary embodiment.

FIG. 2 is a circuit diagram of the display device 10 according to an exemplary embodiment.

The driver 120 includes a first field effect transistor (FET) 298 and a second FET 299 which are connected to a primary coil of a voltage converter 320 and control a current flow, a first diode 322 and a second diode 324 which are connected to a secondary coil of the voltage converter 320 and rectify the output operating voltage Vo, and a first capacitor 326 which is connected to the first diode 322 and the secondary coil and maintains a level of the operating voltage Vo.

When alternating current (AC) power is supplied, it is converted into direct current (DC) power, and the driver 120 converts the DC power into a DC operating voltage to drive the LED 130. The LED 130 emits light in proportion to the amount of current flowing in the LED because the current flow fast with respect to a rising voltage in a forward voltage drop. The MOSFETs 225 and 230 control a voltage between a gate and a source, control a drain current and are driven by a linear method. Thus, at least a minimum voltage, i.e., a drop-out voltage is maintained across the MOSFETs 225 and 230. The driver 120 supplies the operating voltage Vo to the LED 130 in consideration of the forward voltage drop of the LED 130 and the drop-out voltage of the MOSFETs 225 and 230.

The display device 10 according to the current exemplary embodiment may include a plurality of LEDs 130. The plurality of LEDs 130 may be connected in series and form LED strings 132 and 134. The LED strings 132 and 134 may supply light to the display panel 110. That is, a single LED or a plurality of LEDs 130 may supply light. As the number of the LEDs 130 increases, the forward voltage drop of the LED 130 becomes greater and the driver 120 supplies greater operating voltage Vo. The forward voltage drop of the LED 130 is changed upon a current flow. Thus, the driver 120 decreases the operating voltage Vo supplied to the LED 130 when the voltage drop of the LED 130 decreases. The driver 120 increases the operating voltage Vo when the voltage drop of the LED 130 increases. To perform the foregoing operation, the feedback unit 150 detects a level of the voltage drop of the LED 130, and the first controller 140 controls the operating voltage Vo supplied to the LED 130 based on the detection signal of the feedback unit 150.

The feedback unit 150 includes a first transistor 260 in which a base current corresponds to a voltage drop level of the LED 130, a first comparator 280 which is connected to a collector terminal of the first transistor 260 via a non-inverting terminal and receives a collector voltage of the first transistor 260 as an input voltage, and a second transistor 285 connected to an output terminal of the first comparator 280, in which a base current corresponds to an output of the first comparator 280. A voltage drop across a seventh resistor 287 is supplied to a inverting terminal of the first comparator 280. A level of a voltage supplied to the first comparator 280 varies depending on the level of a current Ic. A third diode 332 is connected between the output terminal and the inverting terminal of the first comparator 280 and prevents a reverse current of the first comparator 280.

If a plurality of LED strings 132 and 134 is provided, a current Ia is determined by a greater one of a voltage V1 at a first terminal 300 of the LED string 132 and a voltage V2 at a second terminal 302 of the LED string 134. The voltages V1 and V2 correspond to drain voltages of the third and fourth FETs 230 and 225, respectively. The levels of the voltages V1 and V2 may be changed by the forward voltage drop of the LED strings 132 and 134. That is, as the operating voltage Vo supplied to the LED strings 132 and 134 is constant, the levels of the voltages V1 and V2 increase if the voltage drop of the LED strings 132 and 134 is reduced. As the level of the voltage drop of the LED 130 varies depending on each LED 130, the levels of the voltages V1 and V2 may be different. The first controller 140 controls the operating voltage Vo according to the level of the forward voltage drop of the LED strings 132 and 134.

If the value of at least one of the voltages V1 and V2 increases, the current Ia increases and the base current of the first transistor 260 also increases. If the base current of the first transistor 260 increases, the collector current of the first transistor 260 also increases. A current Ib which is applied to a non-inverting terminal of the first comparator 280 is influenced by a current flowing in a first resistor 275, a second resistor 270, and a first shunt regulator 265, which are connected to the non-inverting terminal of the first comparator 280, and the collector current of the first transistor 260. When the collector current of the first transistor 260 increases, the current Ib decreases, thereby decreasing the base current of the second transistor 285. When the base current of the second transistor 285 decreases, the collector current of the second transistor 285 decreases, thereby decreasing the current Ic.

If the voltage drop of at least one of the LED strings 132 and 134 increases, the level of at least one of the voltages V1 and V2 decreases. The current Ia and the base current of the first transistor 260 also decrease. When the base current of the first transistor 260 decreases, the collector current of the first transistor 260 decreases and the current Ib increases. The base current of the second transistor 285 increases, raising the current Ic. In accordance with the foregoing method, the feedback unit 150 may detect the voltage drop level of the LED strings 132 and 134.

The feedback unit 150 outputs a detection signal, and the first controller 140 controls the driver 120 according to the detection signal. The first controller 140 includes the second shunt regulator 294, first and second photo couplers 295 and 296 and a pulse frequency modulation (PFM) controller 297.

The first and second photo couplers 295 and 296 may include a light emitter and a light receiver, respectively. If a current flows in the light emitter of the first photo coupler 295, light is emitted. The light receiver of the second photo coupler 296 receives the emitted light, and is turned on when the amount of the received light becomes a predetermined value or higher. The PFM controller 297 controls a duty ratio and controls on/off time of the first and second FETs 298 and 299.

The first controller 140 detects the operating voltage Vo supplied to the LED strings 132 and 134 from the driver 120 by using the series-connected third and fourth resistors 290 and 292. If the voltage drop of the LED strings 132 and 134 decreases, the current Ic decreases and the current flowing in the fourth resistor 292 increases. When the voltage of the fourth resistor 292 increases, an input voltage of the second shunt regulator 294 increases, and the current flowing in the first and second photo couplers 295 and 296 increases. The second capacitor 328 maintains a level of the voltage, and is connected between an output terminal of the light emitter of the first photo coupler 295 and the third resistor 290 and the fourth resistor 292.

If the current increases, the light emitter of the first photo coupler 295 emits more light. The light receiver of the second photo coupler 296 receives more light and the PFM controller 297 increases a frequency supplied to the first and second FETs 298 and 299. The driver 120 outputs the operating voltage Vo according to a frequency control of the PFM controller 297. If the frequency increases, the driver 120 decreases the operating voltage Vo.

If the voltage drop of the LED strings 132 and 134 increases, the current Ic increases and the current flowing in the fourth resistor 292 decreases. When the voltage drop of the fourth resistor 292 decreases, the input voltage of the second shunt regulator 294 decreases and the current flowing in the light emitter of the first photo coupler 295 decreases. The light emitter of the first photo coupler 295 emits less light and the light receiver of the second photo coupler 296 receives less light. The PFM controller 297 reduces the frequency and the driver 120 increases the operating voltage Vo.

If the operating voltage Vo of the LED strings 132 and 134 is supplied by the foregoing method, the LED strings 132 and 134 do not need individual driving circuits to control the operating voltage Vo depending on the voltage drop of the LED 130 even when the LED strings 132 and 134 are plural. The LED driving circuit may be simplified, and heat due to the rising drain voltages of the transistors connected in series to the LED strings 132 and 134 may be prevented.

In the display device 10 according to the current exemplary embodiment, a switch is connected in series to the LED strings 132 and 134 to adjust a brightness of the LED strings 132 and 134 and maintain a flow of a constant current. The switch may include at least one of the third FET 230 and the fourth FET 225.

FIG. 2 illustrates two LED strings 132 and 134, and third and fourth FETs 230 and 225 to control the LED strings 132 and 134, respectively, a second controller including at least one of first and second brightness controllers 205 and 215, and a third controller including at least one of first and second current controllers 210 and 220.

The current controllers 210 and 220 each includes fifth and sixth resistors 245 and 318 which are connected in series to the third FET 230 and the fourth FET 225, respectively, and to the inverting input of the second comparator 235 and the third comparator 312. The fifth and sixth resistors 245 and 313 reduce a current flowing in the third and fourth FETs 230 and 225 when a voltage drop of the fifth and sixth resistors 245 and 318 increases. Third and fourth capacitors 314 and 316 which are connected to the non-inverting input of the second comparator 235 and the third comparator 312, respectively, supply a reference voltage to the second and third comparators 235 and 312.

The brightness controllers 205 and 215 include sixth and seventh diodes 250 and 310, respectively, and third and fourth transistors 255 and 308, respectively, which receive a PWM dimming signal. The brightness and constant current control method for a single LED string 132 is described in greater detail below, although it is should be understood that the brightness and constant current control described below is applicable for any of the LED strings 132 and 134.

The third transistor 255 receives a PWM dimming signal as an input signal from a base terminal. A gate terminal of the third FET 230 is connected to an emitter terminal of the third transistor 255 through the sixth diode 250. Thus, the third FET 230 is switched on and off in synchronization with the PWM signal and controls the brightness of the LED string 132.

The current controller 210 controls a preset current to flow in the LED string 132. If a current greater than the preset current flows in the LED string 132, the voltage across the fifth resistor 245 increases. The voltage across the fifth resistor 245 is applied to the inverting terminal of the second comparator 235, and a reference voltage stored in the third capacitor 314 is applied to the non-inverting terminal of the second comparator 235. An output terminal of the second comparator 235 is connected to a gate terminal of the third FET 230. When the voltage across the fifth resistor 245 becomes greater than the reference voltage, a drain-source current of the third FET 230 decreases. Then, the current flowing in the LED string 132 decreases and the preset current flows.

Figure 3:
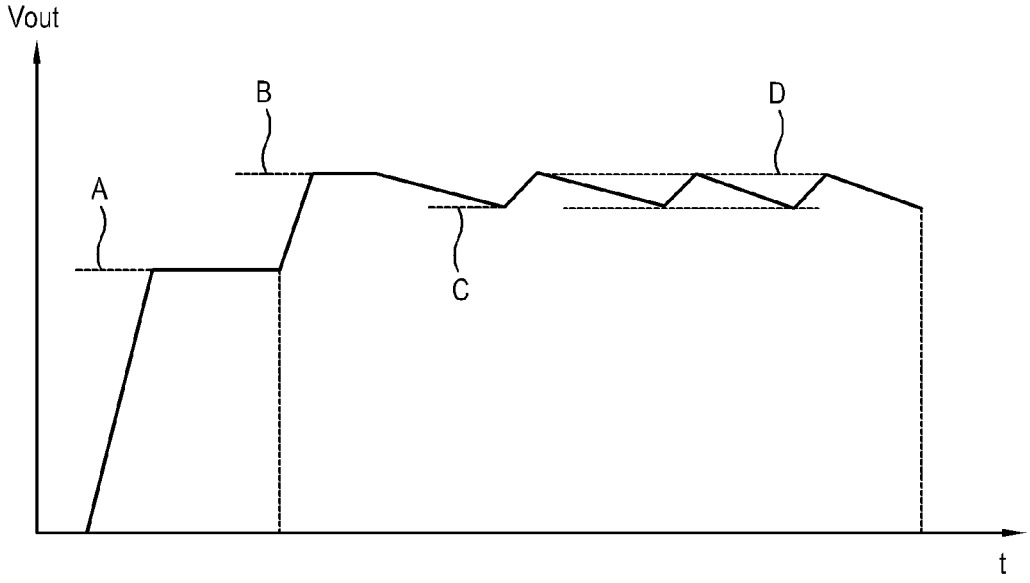
FIG. 3 illustrates fluctuation of an operating voltage supplied to an LED of a display device according to an exemplary embodiment.

FIG. 3 illustrates a fluctuation of the operating voltage Vo supplied to the LED strings 132 and 134 of the display device 10 according to an exemplary embodiment. A level A corresponds to an initial setting voltage of the driver 120. The first controller 140 detects the initial setting voltage of the driver 120 through the third and fourth resistors 290 and 292 and controls the driver 120 to supply the operating voltage Vo of a level B to the LED strings 132 and 134. When a level of the forward voltage drop of the LED strings 132 and 134 decreases, the first controller 140 receives the detection signal of the feedback unit 150 and supplies a voltage at a level C lower than the level B to the LED strings 132 and 134.

If a level of the forward voltage drop of the LED strings 132 and 134 increases, the operating voltage Vo increases accordingly. Thus, the controller 140 supplies the operating voltage Vo at a level D greater than the level C to the LED strings 132 and 134. As described above, the first controller 140 controls the driver 120 to supply the operating voltage Vo at the level C or the level D to the LED strings 132 and 134 according to the detection signal for the forward voltage drop of the LED strings 132 and 134 output by the feedback unit 150.

Figure 4:
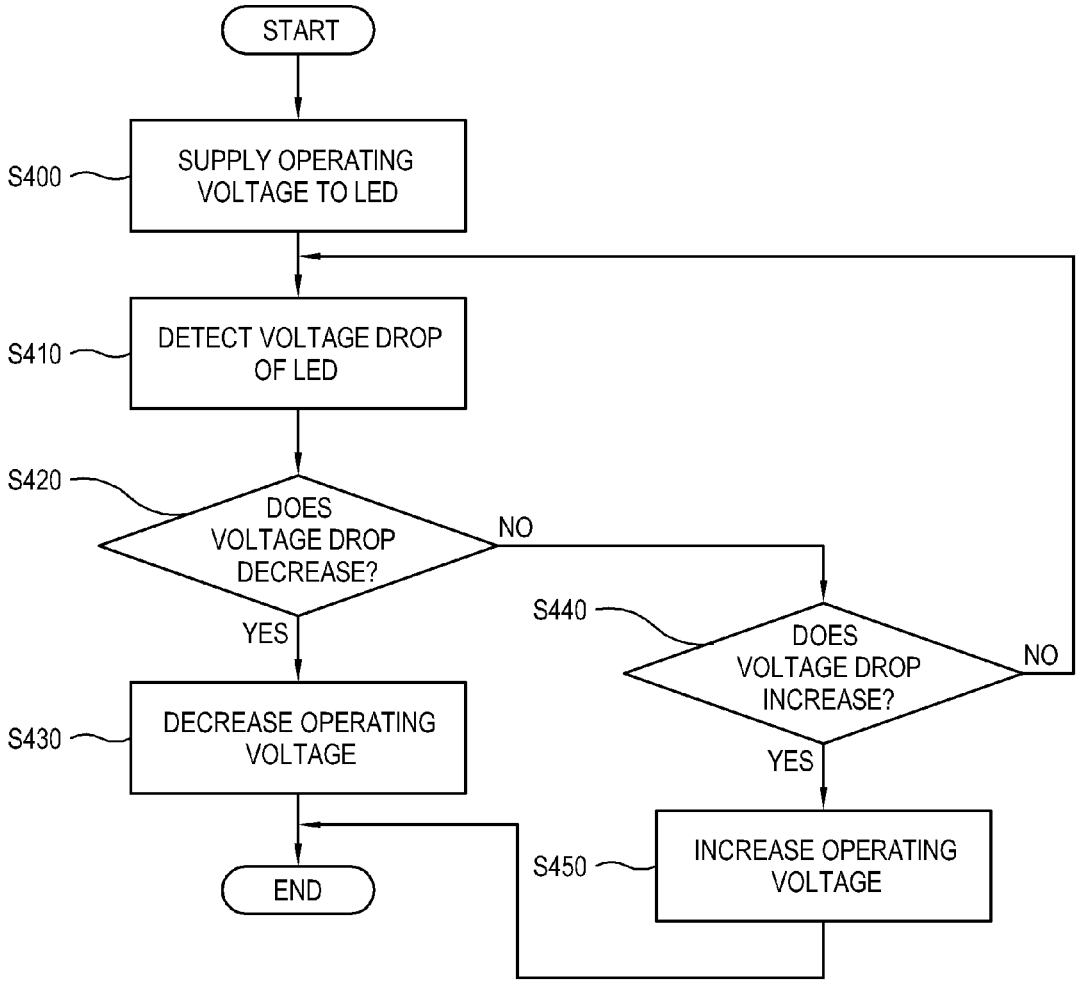
FIG. 4 is a flowchart of a driving process of a display device according to an exemplary embodiment.

FIG. 4 is a flowchart of a driving process of the display device according to an exemplary embodiment. When the driver 120 supplies the operating voltage Vo to the LED 130 (S400), the LED 130 supplies light to the display panel 110. The feedback unit 150 detects a level of the forward voltage drop of the LED 130 (S410). If a level of the forward voltage drop of the LED 130 decreases (YES at operation S420), the first controller 140 controls the driver 120 to decrease the operating voltage Vo supplied to the LED 130 (S430). If a level of the forward voltage drop of the LED 130 increases (YES at operation S440), the first controller 140 controls the driver 120 to increase the operating voltage Vo supplied to the LED 130 (S450).

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display device comprising:

a display panel;

light emitting diodes (LEDs) configured to emit light to the display panel;

a driver configured to supply an operating voltage to the LEDs to drive the LEDs;

a feedback unit configured to detect a level of a voltage drop of the LEDs and output a detection signal corresponding to the detected level of the voltage drop; and a first controller which is configured to control a level of the operating voltage supplied to the LEDs based on the operating voltage supplied to the LEDs and the detection signal, wherein the LEDs comprise:

a first string of series-connected LEDs connected in series to a first terminal, and a second string of series-connected LEDs connected in parallel to the first string and in series to a second terminal; and wherein the feedback unit is configured to output the detection signal corresponding to a greater one of voltage levels at the first terminal and the second terminal indicative of the voltage drop across the first string or the second string, respectively, based on a current level output from the first terminal and the second terminal.

2. The display device according to claim 1, wherein the first controller decreases the level of the operating voltage supplied to the LEDs if the detection signal indicates a decrease in the detected level of the voltage drop of the LEDs.

3. The display device according to claim 1, wherein the first controller increases the level of the operating voltage supplied to the LEDs if the detection signal indicates an increase in the detected level of the voltage drop of the LEDs.

4. The display device according to claim 1, wherein the first controller detects the level of the operating voltage supplied to the LEDs based on a reference voltage, and the feedback unit increases and decreases the reference voltage by outputting the detection signal corresponding to the detected level of the voltage drop of the LEDs.

5. The display device according to claim 1, wherein the feedback unit comprises:

a first transistor which comprises a first collector to adjust a current based on the detected level of the voltage drop of the LEDs;

a second transistor which comprises a second collector to adjust a current corresponding to the first collector current of the first transistor; and a comparator which controls the second transistor to increase or decrease the current of the second collector of the second transistor corresponding to an increase or a decrease of the current of the first collector of the first transistor.

6. The display device according to claim 1, further comprising:

a field effect transistor (FET) which is connected in series to the LEDs; and a second controller which controls the FET to adjust a brightness of the light emitted by the LEDs.

7. The display device according to claim 6, wherein the second controller controls the FET by pulse width modulation.

8. The display device according to claim 6, further comprising a third controller which controls the FET to maintain a level of a current flowing in the LEDs within a predetermined range.

9. The display device according to claim 8, wherein the third controller comprises:

a resistor which is connected in series with the FET; and a comparator which controls the FET to decrease the current flowing in the FET if a voltage drop of the resistor increases.

10. The display device according to claim 1, further comprising:

an image processor which processes an input image signal, wherein the display panel displays an image based on the image signal processed by the image processor.

11. A driving method of a display device, the driving method comprising:

driving light emitting diodes (LEDs) by supplying an operating voltage to the LEDs;

generating a detection signal corresponding to a detected level of a voltage drop of the LEDs; and controlling a level of the operating voltage supplied to the LEDs based on the operating voltage supplied to the LEDs and the detection signal, wherein the LEDs comprise:

a first string of series-connected LEDs connected in series to a first terminal, and a second string of series-connected LEDs connected in parallel to the first string and in series to a second terminal; and wherein the generating the detection signal comprises generating the detection signal corresponding to a greater one of voltage levels at the first terminal and the second terminal indicative of the voltage drop across the first string or the second string, respectively, based on a current level output from the first terminal and the second terminal.

12. The driving method according to claim 11, wherein the controlling the level of the operating voltage comprises reducing the level of the operating voltage supplied to the LEDs if the detection signal indicates a decrease in the detected level of the voltage drop of the LEDs.

13. The driving method according to claim 11, wherein the controlling the level of the operating voltage comprises increasing the level of the operating voltage supplied to the LEDs if the detection signal indicates an increase in the detected level of the voltage drop of the LEDs.

14. The driving method according to claim 11, wherein the controlling the level of the operating voltage comprises controlling the level of the operating voltage supplied to the LEDs based on a reference voltage, and the generating the detection signal comprises increasing and decreasing the reference voltage corresponding to the detected level of the voltage drop of the LEDs.

15. The driving method according to claim 11, further comprising controlling a brightness of light emitted by the LEDs.

16. The driving method according to claim 15, further comprising maintaining a level of a current flowing in the LEDs within a predetermined range.

17. A display apparatus comprising:

a first string of series-connected light emitting diodes (LEDs) connected in series to a first terminal;

a second string of series-connected LEDs connected in parallel to the first string and in series to a second terminal;

a feedback unit which is configured to generate a detection signal corresponding to a greater one of voltage levels at the first terminal and the second terminal indicative of a voltage drop across the first string or the second string, respectively, based on a current level output from the first terminal and the second terminal; and a driver which is connected to the first string, the second string and the feedback unit, and is configured to supply one of a reduced operating voltage level and an increased operating voltage level to the first string and the second string based on the detection signal.

18. The display apparatus of claim 17, wherein the driver supplies the reduced operating voltage level when the detection signal indicates a decrease in the voltage drop across at least one of the first string and the second string and supplies the increased operating voltage level when the detection signal indicates an increase in the voltage drop across the at least one of the first string and the second string.

* * * * *